US011189954B2

(12) United States Patent
Kwon et al.

(10) Patent No.: US 11,189,954 B2
(45) Date of Patent: Nov. 30, 2021

(54) CONNECTOR ASSEMBLY AND METHOD OF MANUFACTURING THE SAME

(71) Applicant: Tyco Electronics AMP Korea Co., Ltd., Gyeongsan-si (KR)

(72) Inventors: Gi Chan Kwon, Gyeongsan-si (KR); Jae Hoon Kim, Gyeongsan-si (KR)

(73) Assignee: Tyco Electronics AMP Korea Co., Ltd., Gyeongsan-Si (KR)

( * ) Notice: Subject to any disclaimer, the term of this patent is extended or adjusted under 35 U.S.C. 154(b) by 0 days.

(21) Appl. No.: 16/885,728

(22) Filed: May 28, 2020

(65) Prior Publication Data

US 2020/0381860 A1 Dec. 3, 2020

(30) Foreign Application Priority Data

May 28, 2019 (KR) ..... 10-2019-0062439
Apr. 22, 2020 (KR) ..... 10-2020-0048871

(51) Int. Cl.

| | |
|---|---|
| ***H01R 11/20*** | (2006.01) |
| ***H01R 13/504*** | (2006.01) |
| ***H01R 43/02*** | (2006.01) |
| ***H01R 13/424*** | (2006.01) |
| ***H01R 43/18*** | (2006.01) |
| ***H01R 4/02*** | (2006.01) |
| *H01R 13/52* | (2006.01) |

(52) U.S. Cl.

CPC ..... *H01R 13/504* (2013.01); *H01R 4/02* (2013.01); *H01R 13/424* (2013.01); *H01R 43/0221* (2013.01); *H01R 43/18* (2013.01); *H01R 13/5219* (2013.01)

(58) Field of Classification Search

CPC . H01R 23/025; H01R 13/5812; H01R 23/005
USPC ..... 439/418, 460, 941
See application file for complete search history.

(56) References Cited

U.S. PATENT DOCUMENTS

| | | | | |
|---|---|---|---|---|
| 6,530,807 | B2 | 3/2003 | Rodrigues et al. | |
| 7,108,548 | B2 | 9/2006 | Burris et al. | |
| 2005/0106929 | A1* | 5/2005 | Meckley ..... | H01R 13/5816 439/418 |

FOREIGN PATENT DOCUMENTS

| | | | |
|---|---|---|---|
| KR | 10-0978986 | B1 | 8/2010 |
| KR | 10-2019-0137765 | A | 12/2019 |

* cited by examiner

*Primary Examiner* — Phuong Chi Thi Nguyen
(74) *Attorney, Agent, or Firm* — Barley Snyder

(57) ABSTRACT

A connector assembly includes a first connector having a first connector body and a first connecting portion protruding from the first connector body, a second connector having a second connector body and a second connecting portion protruding from the second connector body, the second connecting portion overlapping the first connecting portion in a direction perpendicular to a central axis of the second connector, and a terminal fastening lance protruding from the first connector body and extending on an inner side of the second connector body. Of the first connecting portion and the second connecting portion, one disposed on a relatively outer side has a transmitting material that allows a laser to pass therethrough and the other disposed on a relatively inner side has an absorbing material that absorbs the laser. The first connecting portion and the second connecting portion are connected to each other through laser welding.

12 Claims, 8 Drawing Sheets

CONNECTOR ASSEMBLY AND METHOD OF MANUFACTURING THE SAME

CROSS-REFERENCE TO RELATED APPLICATIONS

This application claims the benefit of the filing date under 35 U.S.C. § 119(a)-(d) of Korean Patent Application No. 10-2019-0062439, filed on May 28, 2019, and Korean Patent Application No. 10-2020-0048871, filed on Apr. 22, 2020.

FIELD OF THE INVENTION

The present invention relates to a connector assembly and a method of manufacturing the connector assembly.

BACKGROUND

A connector is an electrical component that enables or blocks an electrical connection. A connector assembly may include a first connector connected to a first device and a second connector connected to a second device required to be electrically connected to the first device. For the connector assembly, a compact and watertight structure may be vital.

The above description has been possessed or acquired by the inventor(s) in the course of conceiving the present disclosure and is not necessarily an art publicly known before the present application is filed.

SUMMARY

A connector assembly includes a first connector having a first connector body and a first connecting portion protruding from the first connector body, a second connector having a second connector body and a second connecting portion protruding from the second connector body, the second connecting portion overlapping the first connecting portion in a direction perpendicular to a central axis of the second connector, and a terminal fastening lance protruding from the first connector body and extending on an inner side of the second connector body. Of the first connecting portion and the second connecting portion, one disposed on a relatively outer side has a transmitting material that allows a laser to pass therethrough and the other disposed on a relatively inner side has an absorbing material that absorbs the laser. The first connecting portion and the second connecting portion are connected to each other through laser welding.

BRIEF DESCRIPTION OF THE DRAWINGS

The invention will now be described by way of example with reference to the accompanying Figures, of which.

DETAILED DESCRIPTION OF THE EMBODIMENTS

Figure 1:
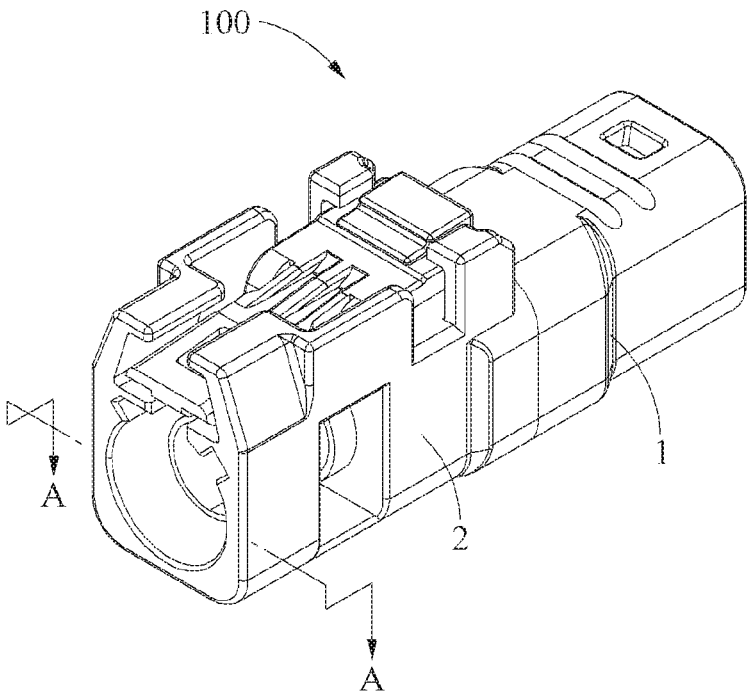
FIG. 1 is a perspective view of a connector assembly according to an embodiment.

Hereinafter, exemplary embodiments will be described in detail with reference to the accompanying drawings. It should be understood, however, that there is no intent to limit this disclosure to the particular example embodiments disclosed. On the contrary, example embodiments are to cover all modifications, equivalents, and alternatives falling within the scope of the example embodiments.

The terminology used herein is for the purpose of describing particular example embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

In the description of example embodiments, detailed description of well-known related structures or functions will be omitted when it is deemed that such description will cause ambiguous interpretation of the present disclosure.

Terms such as first, second, A, B, (a), (b), and the like may be used herein to describe components. Each of these terminologies is not used to define an essence, order, or sequence of a corresponding component but used merely to distinguish the corresponding component from other component(s). It should be noted that if it is described in the specification that one component is "connected," "coupled," or "joined" to another component, a third component may be "connected," "coupled," and "joined" between the first and second components, although the first component may be directly connected, coupled or joined to the second component. In addition, it should be noted that if it is described in the specification that one component is "directly connected" or "directly joined" to another component, a third component may not be present therebetween. Likewise, expressions, for example, "between" and "immediately between" and "adjacent to" and "immediately adjacent to" may also be construed as described in the foregoing.

Hereinafter, example embodiments will be described in detail with reference to the accompanying drawings. Regarding the reference numerals assigned to the elements in the drawings, it should be noted that the same elements will be designated by the same reference numerals, wherever possible, even though they are shown in different drawings.

Figure 2:
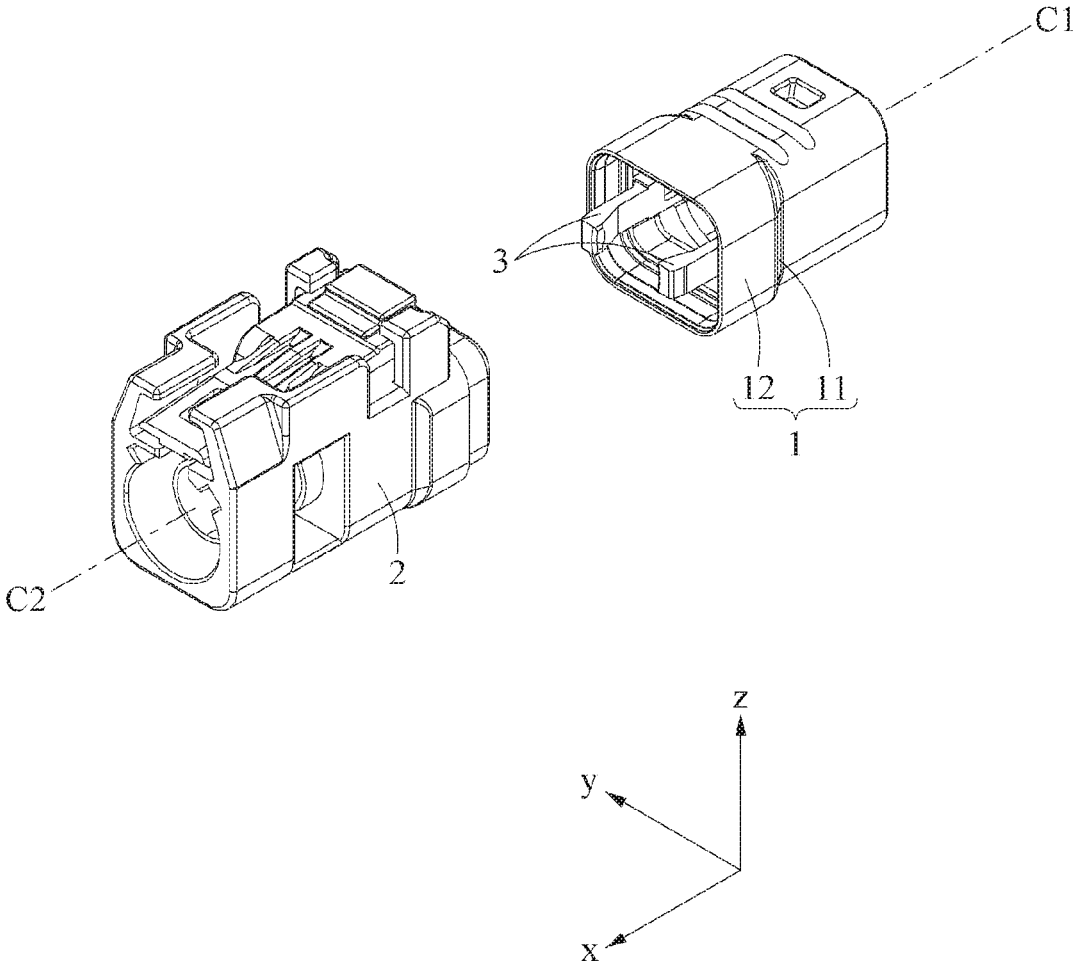
FIG. 2 is an exploded perspective view of the connector assembly.
Figure 3:
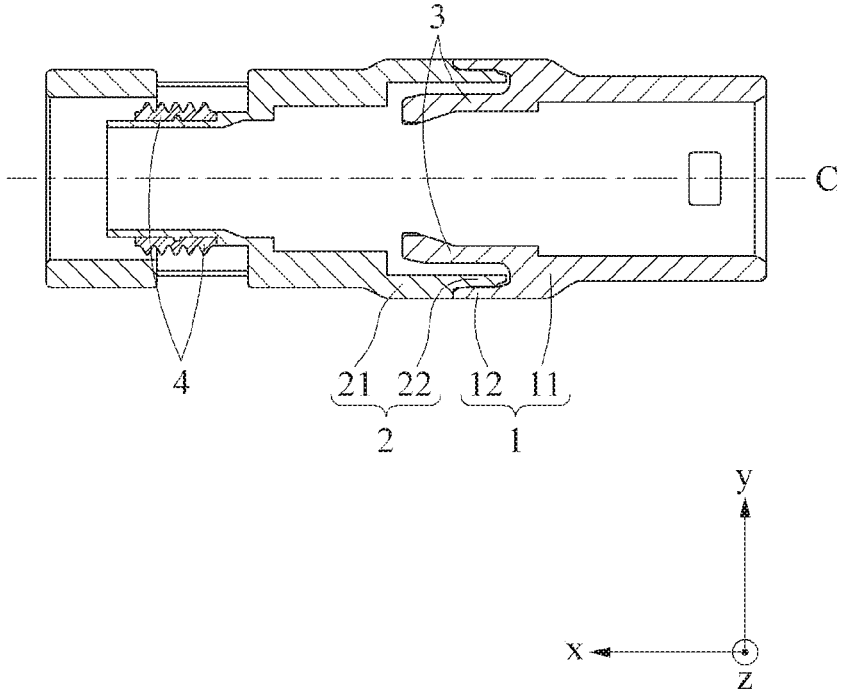
FIG. 3 is a sectional side view of the connector assembly, taken along line A-A in FIG. 1.

As shown in FIGS. 1-3, a connector assembly 100 includes a first connector 1 and a second connector 2 that are configured to be connected to each other, a terminal fastening lance 3, and a main seal 4. The first connector 1 and the second connector 2 may be connected to each other with at least a portion therebetween overlapping.

The first connector 1 includes a first connector body 11 and a first connecting portion 12 protruding from the first connector body 11, as shown in FIGS. 2 and 3. The first connector body 11 is provided in a prismatic shape with a hollow portion at a center thereof based on a central axis C1. For example, the first connector body 11 may be provided in a cylindrical shape.

Figure 7:
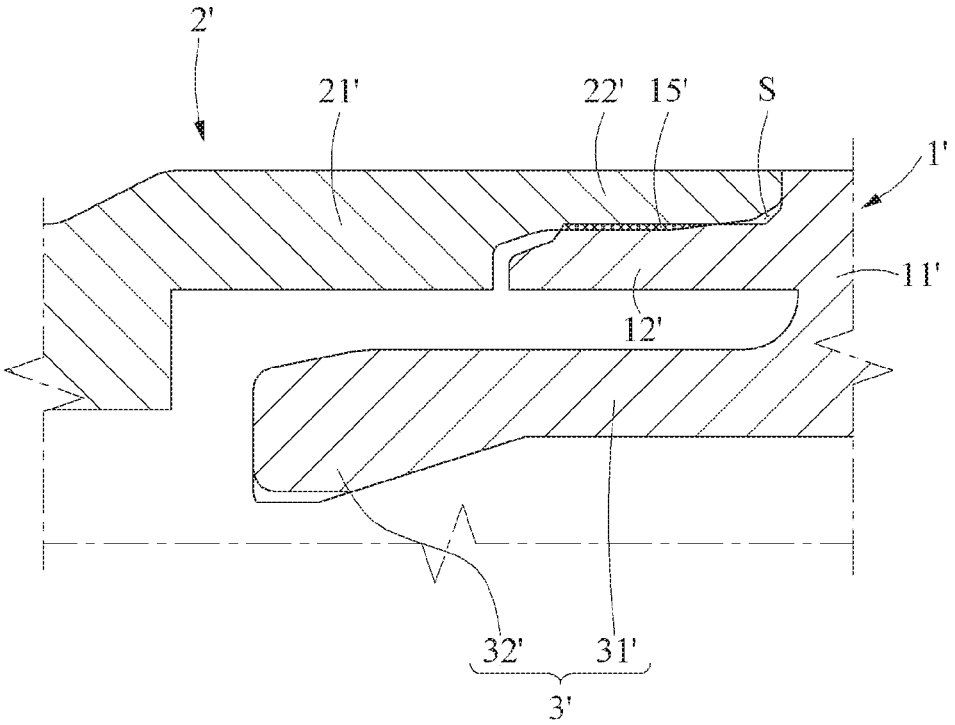
FIG. 7 is an enlarged sectional view of a connector assembly according to another embodiment.

The second connector 2 includes a second connector body 21 is aligned with the first connector body 11 in parallel and a second connecting portion 22 protruding from the second connector body 21, as shown in FIG. 3. The second connector body 21 is provided in a prismatic shape with a hollow portion at a center thereof based on a central axis C2. For example, the second connector body 21 may be provided in a cylindrical shape. The second connecting portion 22 overlaps the first connecting portion 12 in a direction perpendicular to the central axis C1 of the first connector 1 and/or the central axis C2 of the second connector 2. For example, the second connecting portion 22 may be disposed on an outer side or an inner side relative to the first connecting portion 12 in the direction perpendicular to the central axis C1 and/or the central axis C2. Although the second connecting portion 22 is illustrated as being disposed on the inner side relative to the first connecting portion 12, examples are not limited thereto. For example, as illustrated in FIG. 7, a second connecting portion 22' may be disposed on an outer side relative to a first connecting portion 12'. The central axis C1 of the first connector body 11 and the central axis C2 of the second connector body 21 are in parallel to each other, which are collectively illustrated as C in FIG. 3.

Of the first connecting portion 12 and the second connecting portion 22, the first connecting portion 12 disposed on a relatively outer side may have a transmitting material that allows a laser to be transmitted therethrough, and the second connecting portion 22 may have an absorbing material that absorbs the laser. The first connecting portion 12 and the second connecting portion 22 may be connected through laser welding. A laser may be radiated to the first connecting portion 12 and the second connecting portion 22. The radiated laser may pass through the first connecting portion 12 having the transmitting material, and then reach the second connecting portion 22 having the absorbing material. A portion of the second connecting portion 22 may be melted by the laser, and a melt generated thereby may connect the first connecting portion 12 and the second connecting portion 22.

The terminal fastening lance 3 protrudes from the first connector body 11 and extends on an inner side of the second connector body 21, as shown in FIG. 3. The terminal fastening lance 3 protrudes from the first connector body 11 by a length greater than a length by which the first connecting portion 12 protrudes from the first connector body 11.

The terminal fastening lance 3 is separate from the second connector body 21 by a certain distance. The terminal fastening lance 3 may support a terminal (not shown) that is to be mounted to the connector assembly 100 to prevent the terminal from escaping from the connector assembly 100. For example, the terminal may be inserted inwardly in the connector assembly 100 in a direction of +x in FIG. 3. While the terminal is being inserted, the terminal fastening lance 3 may be elastically deformed in a direction toward the second connector body 21. When the terminal is completely inserted, the terminal fastening lance 3 may return to its original shape. When the terminal is completely inserted, the terminal fastening lance 3 may support one side of the terminal to prevent the terminal from receding in a direction of −x. The terminal fastening lance 3 may be provided as a plurality of terminal fastening lances in number.

The main seal 4, shown in FIG. 3, may be used for sealing between the connector assembly 100 and a plug (not shown) when the plug is connected to the connector assembly 100. A seal may be required only for the sealing between the connector assembly 100 and the plug, and a seal may not be required for sealing the connector assembly 100 itself. The connector assembly 100 may not require an additional seal for sealing a connected portion between the first connector 1 and the second connector 2 because the first connector 1 and the second connector 2 are connected to each other through the laser welding.

Figure 4:
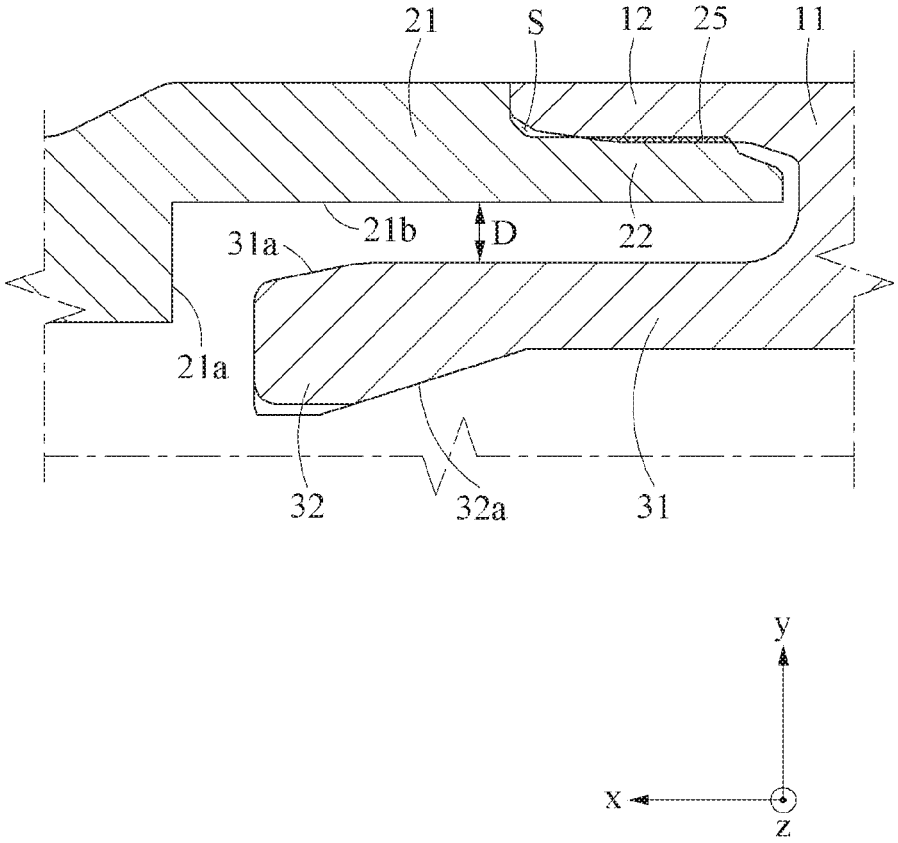
FIG. 4 is an enlarged sectional view of the connector assembly of FIG. 3 before laser welding.
Figure 5:
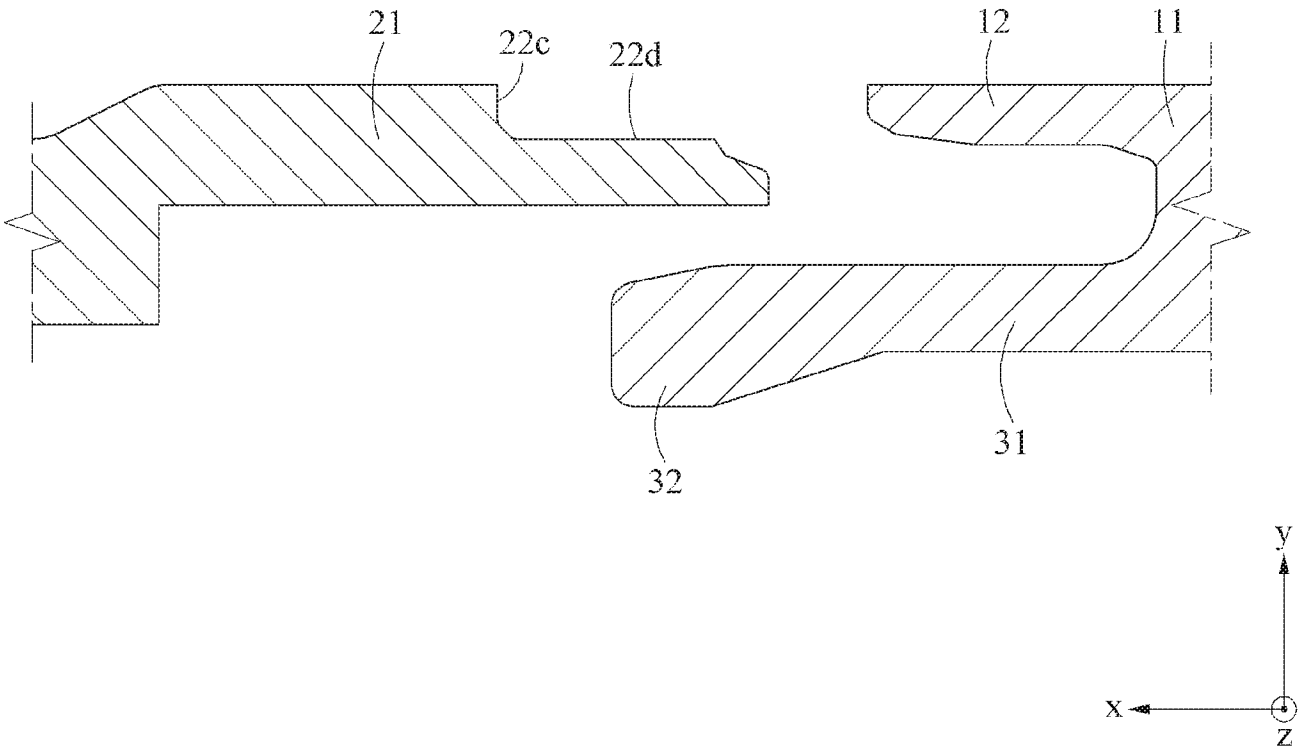
FIG. 5 is an enlarged sectional view of the connector assembly in a disassembled state.
Figure 6:
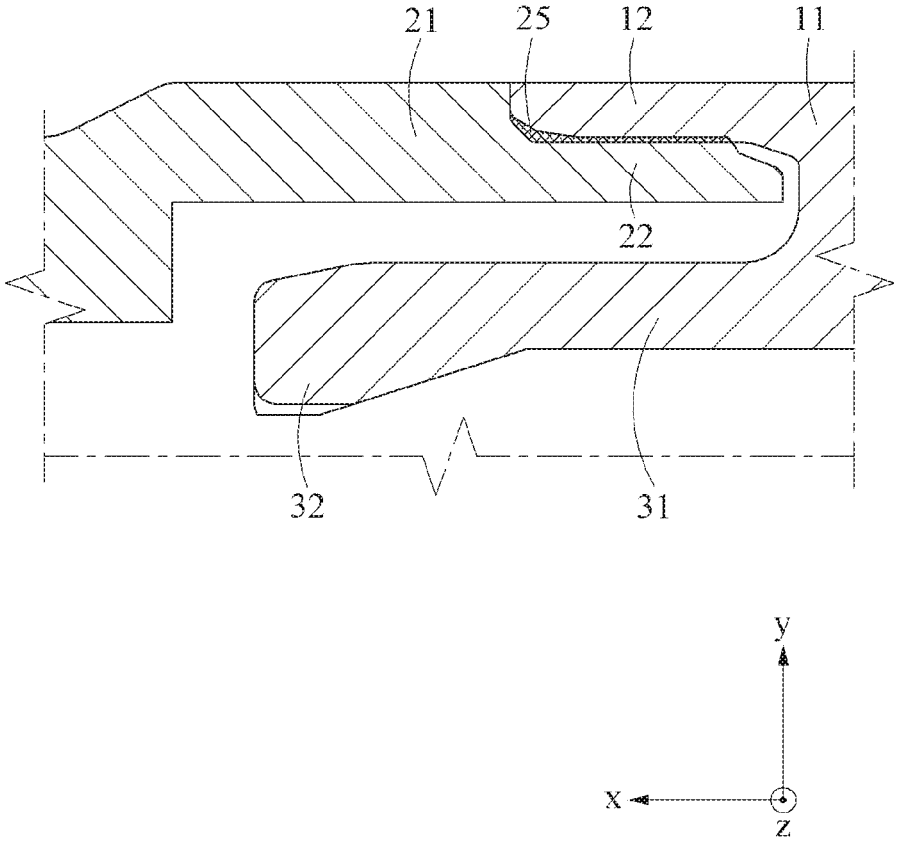
FIG. 6 is an enlarged sectional view of the connector assembly of FIG. 4 after laser welding.

Referring to FIGS. 4-6, the terminal fastening lance 3 of the connector assembly 100 is separate from the second connector body 21. The terminal fastening lance 3 includes a lance body 31 and a lance head 32. The lance body 31 protrudes from the first connector body 11 in a direction of +x. The lance body 31 is separate from an inner wall of the second connector body 21 and the second connecting portion 22 in a direction toward a central axis of the second connector 2. The lance body 31 overlaps the second connector body 21 along a direction in which the lance body 31 protrudes.

The lance body 31, as shown in FIG. 4, includes a tilted body portion 31*a* of which a distance from the second connector body 21 increases as it is farther from the first connector body 11. While a terminal (not shown) is being inserted into the connector assembly 100 in the direction of +x, the lance body 31 may be deformed in a direction toward the second connector body 21. Here, the tilted body portion 31*a* may be provided to prevent the lance body 31 from contacting the second connector body 21.

The lance head 32 protrudes from the lance body 31 in a direction toward a central axis of the first connector 1, for example, a direction of −y, as shown in FIGS. 4-6. The lance head 32 may be fastened to the terminal, and thus prevent the terminal from escaping from the connector assembly 100.

The lance head 32, as in an embodiment shown in FIGS. 4-6, may not overlap the first connecting portion 12 in a direction perpendicular to the central axis of the first connector 1. That is, the lance head 32 may be arranged at a position different from the first connecting portion 12 and the second connecting portion 22 along a longitudinal direction of the connector assembly 100. Such a structure may prevent a laser from reaching the lance head 32 unintentionally during the laser welding.

The lance head 32, as shown in FIG. 4, includes a tilted head portion 32*a* of which a length protruding from the lance body 31 increases as it is farther from the first connector body 11. While the terminal is being inserted into the connector assembly 100 in the direction of +x, the terminal may generate a torque that rotates the terminal fastening lance 3 in a direction of +y due to the tilted head portion 32*a*. The terminal fastening portion 3 may be deformed by the terminal and then return to its original shape when the terminal passes, thereby fastening the terminal.

As shown in FIG. 4, the second connector body 21 includes a stepped surface 21*a* facing at least a portion of a front side of the terminal fastening lance 3, and an inner side surface 21*b* facing the lance body 31 while being separate from the lance body 31 by a certain distance D in a y-axis direction. The stepped surface 21*a* is separate from a front end portion of the lance body 31. That is, the second connector body 21 may be provided in a shape having a groove recessed in the y-axis direction. Through such a structure, the connector assembly 100 may be provided in a compact shape having a relatively greater external diameter only in a portion in which the terminal fastening lance 3 is provided, and having a relatively smaller external diameter in remaining portions. In addition, the second connector body 21 may have a sufficiently great thickness of a portion in which the terminal fastening lance 3 is not provided, for example, a portion disposed in the direction of +x from the terminal fastening lance 3, and thus the connector assembly 100 may have a sufficiently great level of durability.

The second connecting portion 22, as shown in FIGS. 4-6, includes a receiving groove to receive the first connecting portion 12. For example, as illustrated in FIG. 5, the second connecting portion 22 includes a first receiving surface 22*c* facing a front side of the first connecting portion 12, and a second receiving surface 22*d* facing an inner side surface or an outer side surface of the first connecting portion 12. Although the second receiving surface 22*d* is illustrated as facing the inner side surface of the first connecting portion 12 in FIGS. 4-6, the second receiving surface 22*d* may also face the outer side surface of the first connecting portion 12 as illustrated in FIG. 7. The first receiving surface 22*c* and the second receiving surface 22*d* may form a stepped portion therebetween. In a state in which the first connecting portion 12 is settled on the first receiving surface 22*c* and the second receiving surface 22*d*, the outer side surface of the first connecting portion 12 and an outer side surface of the second connector body 21 may be connected seamlessly without a stepped portion, as shown in FIG. 6. Through such a structure, an external diameter of the connector assembly 100 may be reduced, and thus the connector assembly 100 may be provided in a compact structure.

Based on a state before the laser welding is performed, a melt receiver S is provided between an end portion of the first connecting portion 12 and the second connector body 21 of the second connector 2, as shown in FIG. 4. The melt receiver S may be filled with a melt of a connecting portion having an absorbing material, for example, the second connecting portion 22, during the laser welding.

Although the first connecting portion 12 and the second connecting portion 22 are illustrated as overlapping each other in FIG. 4 for the convenience of description, the overlapping of the first connecting portion 12 and the second connecting portion 22 is physically impossible, and one of the first connecting portion 12 and the second connecting portion 22 may deform the other one. For example, an elastic modulus of a connecting portion having a transmitting material, for example, the first connecting portion 12, may be greater than an elastic modulus of a connecting portion having an absorbing material, for example, the second connecting portion 22. In this example, the second connecting portion 22 may be deformed outwardly. In this example, when the laser welding is performed in such a state, a melt generated by the laser welding may move to the melt receiver 25 more readily, without moving to an unintended area, for example in a direction toward the terminal fastening lance 3.

For example, as illustrated in FIG. 4, at least a portion of an outer wall of the second connecting portion 22 may be melted to become a melt 25 and then be coagulated again, thereby connecting the second connecting portion 22 to the first connecting portion 12. A portion of the melt 25 may be coagulated on a surface on which the first connecting portion 12 and the second connecting portion 22 face each other, and a remainder of the melt 25 may move into the melt receiver S to be coagulated therein, as shown in FIG. 6.

The first connecting portion 12 may be arranged on an outer side of the second connecting portion 22, and the first connecting portion 12 and the terminal fastening lance 3 may have a transmitting material that allows a laser to be transmitted therethrough. Thus, even if the laser reaches the terminal fastening lance 3 unintentionally, the terminal fastening lance 3 may transmit the laser and not be deformed.

A connector assembly according to another embodiment is shown in FIG. 7. A first terminal 1' includes a first connector body 11' and a first connecting portion 12', and a second terminal 2' includes a second connector body 21' and a second connecting portion 22'. A portion 15' of the first connector body 11' that is illustrated as overlapping the second connector body 21' may be a portion to be melted during laser welding. At least a portion of the portion 15' may be coagulated, a remainder thereof may move into a melt receiver S to be coagulated therein.

As shown in FIG. 7, the first connecting portion 12' of the first terminal 1' may be arranged on an inner side of the second connecting portion 22' of the second terminal 2'. The first connecting portion 12' may have an absorbing material that absorbs a laser, and the second connecting portion 22' may have a transmitting material that allows the laser to be transmitted therethrough. A terminal fastening lance 3' includes a lance body 31' and a lance head 32' protruding from the lance body 31'. Although the lance body 31' is described above as being formed by protruding from the first terminal 1', the lance body 31' may also protrude in a direction from the second terminal 2' toward the first terminal 1'.

Figure 8:
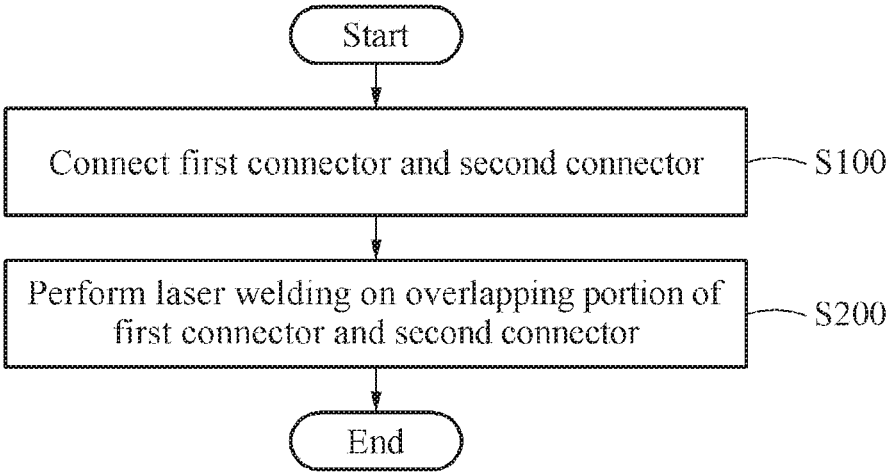
FIG. 8 is a flowchart of a method of manufacturing a connector assembly according to an embodiment.

A method of manufacturing a connector assembly according to an example embodiment is shown in FIG. 8. The method includes a step S100 of connecting a first connector and a second connector, and a step S200 of performing laser welding on an overlapping portion of the first connector and the second connector. The overlapping portion indicates a portion at which the first connector and the second connector overlap each other.

In S100 in FIG. 8, of a connecting portion of the first connector and a connecting portion of the second connector, one connecting portion is inserted into the other connecting portion. For example, of the two connecting portions, one that is arranged outwards may allow a laser to be transmitted therethrough, and the other one that is arranged inwards may absorb the laser. In this example, the connecting portion arranged outwards may have an elastic modulus that is greater than an elastic modulus of the connecting portion arranged inwards, and be deformed outwardly while the connecting portion of the first connector and the connecting portion of the second connector are connected to each other.

In S200 in FIG. 8, the laser welding is performed on the overlapping portion of the first connector and the second connector. When the laser welding is performed, the first connector and the second connector are connected to each other, and thus no fluid may enter between the first connector and the second connector.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

What is claimed is:

1. A connector assembly, comprising:

a first connector having a first connector body and a first connecting portion protruding from the first connector body;

a second connector having a second connector body and a second connecting portion protruding from the second connector body, the second connecting portion overlapping the first connecting portion in a direction perpendicular to a central axis of the second connector; and a terminal fastening lance protruding from the first connector body and extending on an inner side of the second connector body, of the first connecting portion and the second connecting portion, one disposed on a relatively outer side has a transmitting material that allows a laser to pass therethrough and the other disposed on a relatively inner side has an absorbing material that absorbs the laser, the first connecting portion and the second connecting portion are connected to each other through laser welding;

a melt receiver arranged between an end portion of the first connecting portion and the second connector, the melt receiver receiving a melt of the one of the first connecting portion and the second connecting portion having the absorbing material during the laser welding.

2. The connector assembly of claim 1, wherein a length by which the terminal fastening lance protrudes from the first connector body is greater than a length by which the first connecting portion protrudes from the first connector body.

3. The connector assembly of claim 1, wherein an elastic modulus of the one of the first connecting portion and the second connecting portion having the transmitting material is greater than an elastic modulus of the one of the first connecting portion and the second connecting portion having the absorbing material.

4. The connector assembly of claim 1, wherein the terminal fastening lance has the transmitting material.

5. The connector assembly of claim 1, wherein the terminal fastening lance is separate from the second connector body.

6. The connector assembly of claim 5, wherein the second connector body has a stepped surface facing at least a portion of a front side of the terminal fastening lance.

7. The connector assembly of claim 5, wherein the second connecting portion has a first receiving surface facing a front side of the first connecting portion and a second receiving surface facing an inner side surface or an outer surface of the first connecting portion.

8. The connector assembly of claim 1, wherein the terminal fastening lance has a lance body protruding from the first connector body and a lance head protruding from the lance body in a direction toward a central axis of the first connector.

9. The connector assembly of claim 8, wherein the lance head does not overlap the first connecting portion in a direction perpendicular to the central axis of the first connector.

10. The connector assembly of claim 8, wherein the lance body overlaps the second connector body along a direction in which the lance body protrudes.

11. The connector assembly of claim 8, wherein the lance body has a tilted body portion of which a distance from the second connector body increases as it is further from the first connector body.

12. The connector assembly of claim 11, wherein the lance head has a tilted head portion of which a length protruding from the lance body increases as it is further from the first connector body.

* * * * *